United States Patent [19]

Mozer

[11] 4,435,831

[45] Mar. 6, 1984

[54] METHOD AND APPARATUS FOR TIME DOMAIN COMPRESSION AND SYNTHESIS OF UNVOICED AUDIBLE SIGNALS

[76] Inventor: Forrest S. Mozer, 38 Somerset Pl., Berkeley, Calif. 94707

[21] Appl. No.: 335,310

[22] Filed: Dec. 28, 1981

[51] Int. Cl.[3] ..... G10L 1/00

[52] U.S. Cl. ..... 381/30; 381/35; 381/53; 364/717; 331/78; 84/1.01

[58] Field of Search ..... 381/30, 29, 31–40, 381/51–53; 328/13, 14, 16, 109; 364/717; 375/122; 84/1.01, 1.24; 331/78

[56] References Cited

U.S. PATENT DOCUMENTS

| | | | |
|---|---|---|---|
| 3,968,448 | 7/1976 | Stenning | 328/109 |
| 4,194,427 | 3/1980 | Deutsch | 364/717 |
| 4,214,125 | 7/1980 | Mozer et al. | 381/51 |
| 4,327,419 | 4/1982 | Deutsch et al. | 364/717 |
| 4,395,703 | 7/1983 | Piosenka | 331/78 |

OTHER PUBLICATIONS

Harding, "Generation of Random Digital Numbers", Radio and Electronic Engineer, Jun. 1968, pp. 369–375.

*Primary Examiner*—E. S. Kemeny

*Attorney, Agent, or Firm*—Townsend and Townsend

[57] ABSTRACT

Compression and synthesis techniques and related apparatus for time domain signals, particularly signals whose information content resides in the power spectrum such as speech and more particularly signals whose amplitude is aperiodic, such as unvoiced speech sounds. Compression techniques include eliminating serially redundant segments of information. Synthesis, particularly of unvoiced sounds which are sensitive to injected artificial periodicity, involves repeating sequentially portions of the same segment representative of the source signal, including commencing and terminating at different points each repetition, varying the length of the portion and reproducing the portion forwards and backwards in time. The invention finds application in speech compression and compact speech synthesis devices.

12 Claims, 9 Drawing Figures

METHOD AND APPARATUS FOR TIME DOMAIN COMPRESSION AND SYNTHESIS OF UNVOICED AUDIBLE SIGNALS

BACKGROUND OF THE INVENTION

1. Field of Invention

The invention relates to information compression techniques applicable to audible sounds and particularly to speech compression, storage, transmission and synthesis techniques. More particularly, the invention is applicable to time domain speech compression and synthesis of unvoiced speech sounds. The invention also finds application where the information content of a signal resides in the power spectrum but not in phase components of equivalent composite signals.

Normal speech and like audible sounds contain about 100,000 bits of information per second. Storage and transmission of large quantities of such information can be prohibitive in cost, bandwidth and storage space. Hence, there is a substantial need to eliminate storage and transmission of any redundant or otherwise unnecessary information in speech and like audible signals. Speech compression and synthesis techniques have been developed to decrease the information content of the signal so as to decrease the required transmission bandwidth and storage requirements. The major challenge, however, is to minimize the information content of the compressed information with minimal degradation of signal intelligibility and quality.

It has been determined that speech and like audible sounds exhibit certain characteristics which can be exploited to minimize information redundancy while retaining essential quality characteristics. The energy source, for example, may be either a voiced or unvoiced excitation. In speech, voiced excitation is achieved by periodic oscillation of the vocal chords at a frequency called the pitch frequency for minimum periods called pitch periods. The vowel sounds normally result from such a voiced excitation.

Unvoiced excitation is achieved by passing air through the vocal system without causing the vocal chords to oscillate. Examples of unvoiced excitation includes the plosives such as /p/ (as in "pow"), /t/ (as in "tall") and /k/ (as in "ark"); the fricatives such as /s/ (as in "seven"), /f/ (as in "four"), /th/ (as in "three"), /h/ (as in "high"), /sh/ (as in "shell"), /ch/ (as in the German word "acht"); and all whispered speech. Voiced sounds exhibit quasi-periodic amplitude variation with time. However, unvoiced sounds, such as the fricatives, the plosives and other audible signals, including moving air, the closing of a door, the sounds of collisions, jet aircraft, and the like, have no such quasi-periodic structure, resembling rather random white noise.

It is well-known that the intelligibility of speech phonemes and unvoiced sounds primarily resides in the power spectrum of the signal. The power spectrum is analyzed by the human brain through signal averaging over a time on the order of ten milliseconds. The source signals, however, have a power spectrum which changes on a time scale of tens to hundreds of milliseconds, suggesting the possibility that ten millisecond segments of a signal, particularly signals representing unvoiced sounds, could be stored at intervals and repetitively reproduced in a synthesis process. However, it has been discovered that such a technique does not produce intelligible information. Rather, multiple repetition of the same segment has been found to produce a distinct periodicity such as a buzz at the frequency of repetition rendering phonemes and words in the vicinity of unvoiced sounds virtually unintelligible. What is needed is a compression and synthesis technique which will permit the use of a representative segment of an unvoiced sound to reproduce the unvoiced sound over an extended period.

2. Description of the Prior Art

Compression and synthesis of speech signals and the like have been studied for several decades. (See, for example, Flanagan, *Speech Analysis, Synthesis and Perception,* Springer-Verlag, 1972.) Interest in the topic has accelerated with the increased technical ability to fabricate complex electronic circuits in a single integrated circuit through the techniques of Large-Scale Integration. Compression and synthesis techniqes are generally divided into two categories, frequency domain techniques and time domain techniques. These techniques are distinguished in terms of the type of data stored and utilized. Frequency domain synthesis achieves its compression by storing information on the important frequencies in each speech segment or pitch period.

Examples of frequency domain synthesizers are given in U.S. Pat. No. 3,575,555 and in 3,588,353.

Time domain synthesizers, in contrast, store a representative version of the signal in the form of amplitude values as a function of time.

Known digital time domain compression techniques have been described in U.S. Pat. No. 3,641,496 to Slavin; U.S. Pat. No. 3,892,919 to Ichikawa; and in U.S. Pat. No. 4,214,125 to Mozer et al.

In 1975, the first LSI time domain speech synthesizer was fabricated using compression techniques described in U.S. Pat. No. 4,214,125. Since the introduction of the time domain speech synthesizer, various versions of LSI speech synthesizer devices have been designed and introduced for a variety of applications, particularly in the consumer markets.

According to the invention, a time domain signal whose information content resides primarily in the power spectrum as opposed to the phase components of the frequency domain transform, and particularly an aperiodic signal such as an unvoiced speech sound, may be synthesized by repetitively reproducing a representative segment of a longer duration signal period in a manner which avoids injection of artificial harmonics caused by the repetitions. The synthesized signal is developed by quasi randomly commencing and terminating the segment at points other than the beginning and end of the segment, and further by reproducing the segment in a quasi random sequence of forward and backward directions in time. The playout of the segment in this manner minimizes the buzzing, clicking or other noticeable artificial repetitions which often characterize aperiodic signals reproduced by a sample segment.

The compression technique and synthesis technique may be employed with other time domain compression and synthesis techniques suited to unvoiced sounds to produce an output requiring minimized storage space and bandwidth.

One of the primary objects of the invention is to develop new methods for compressing the information content of speech signals and like audible waveforms without substantially degrading the quality of the resulting sound in order to reduce the cost and size of speech synthesizing devices. In particular, an object of the invention is to provide a compression method particularly applicable to time domain synthesis.

A further object of the invention is to reduce the amount of digital information required to be stored or transmitted thereby to reduce the bandwidth requirements and memory size requirement in an analog output signaling system.

The foregoing and other objectives, features, and advantages of the invention will be more readily understood upon consideration of the following detailed description of certain specific embodiments of the invention taken in conjunction with the accompanying drawings.

DESCRIPTION OF SPECIFIC EMBODIMENTS

Since the intelligibility of different voiced and unvoiced sounds is contained in the power spectrum rather than in the phase angles, certain liberties can be taken with the phase characteristics of the aperiodic (unvoiced) and quasi periodic (voiced) sounds. For example, the power spectrum of a substantially invariant signal is the same when it is reproduced both backwards and forwards. Second, the power spectrum of any portion of a substantially invariant segment is on the average substantially the same as that of the entire segment.

Figure 1:
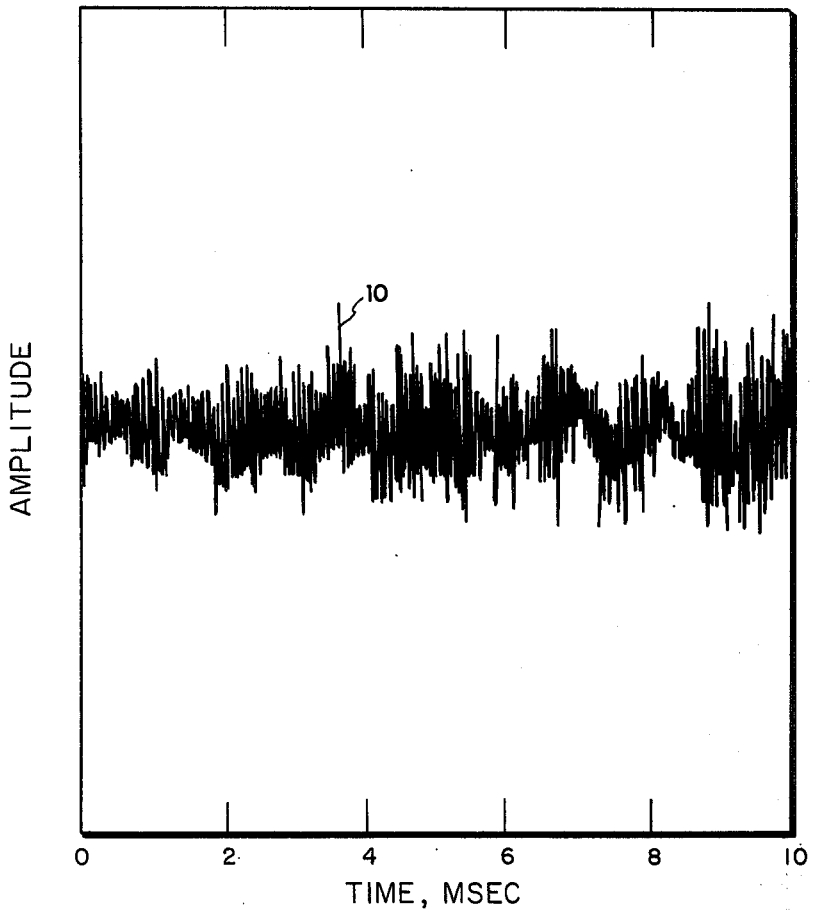
FIG. 1 is a waveform diagram of the amplitude of an unvoiced signal as a function of time, where the waveform is that of the audible phoneme /s/.
Figure 2:
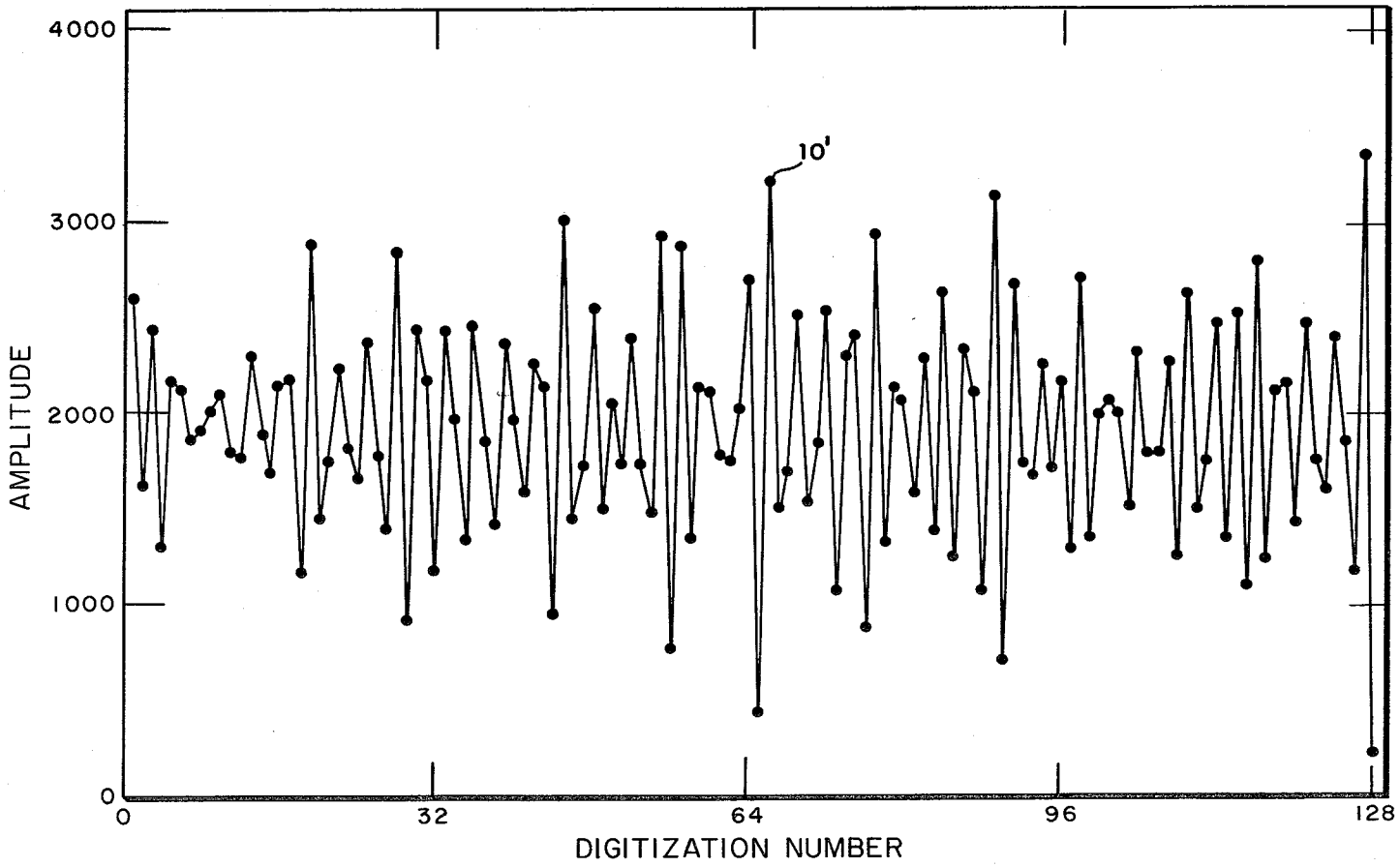
FIG. 2 is a waveform diagram of the amplitude as a function of time for the phoneme /s/ reconstructed from 128 samples.

Turning to FIG. 1 for example there is shown an amplitude diagram of a waveform 10 of the unvoiced phoneme /s/. FIG. 2 shows a waveform 10' which is a ten millisecond digitization of the phoneme /s/ comprising 128 samples digitized to 12-bit accuracy.

The power spectrum of a speech waveform is analyzed by the brain through averaging for a time on the order of ten milliseconds. In most cases, the power spectrum of a signal changes on a time scale of many tens of milliseconds and has a duration on the order of hundreds of milliseconds. Thus, short segments of the unvoiced waveform may be stored as representations of longer duration segments, and a synthesizer could be employed to reproduce the segments a sufficient number of times to reconstruct the represented longer time segment. For a ten millisecond segment representing a fifty millisecond interval, a compression factor of five could be achieved.

Straightforward application of this technique, however, produces a distinct buzz or a noticeable periodicity due to the repetition of identical segments. The buzz is frequently sufficient to render unintelligible not only the interval of interest but also several words in the vicinity of the interval of interest.

The problem can be overcome according to the invention by recognizing that the power spectrum of an unvoiced waveform which determines the desired sound has certain unique characteristics. First, the power spectrum of a waveform segment played backwards is the same as if it were played forward in time. Second, the power spectrum for a portion of a segment is on the average the same as the power spectrum for the entire segment.

Therefore, according to the invention, the characteristic buzz of repeated segments representing an entire interval may be eliminated by repeatedly reading out, playing out or otherwise reproducing the representative segment, particularly for unvoiced sounds, beginning and ending at quasi random points for the duration of the desired interval. For example, a hypothetical compression factor of five can be achieved by repeating a ten millisecond segment for fifty milliseconds beginning first with the entire segment from sample one through the end, then playing the entire segment backward from the last sample to the first, then reproducing the last two-thirds of the segment, then reproducing the first two-thirds of the segment, then reproducing the middle two-thirds of the segment backwards, then reproducing the last half of the segment, and finally reproducing the first half of the segment backwards.

Figure 3:
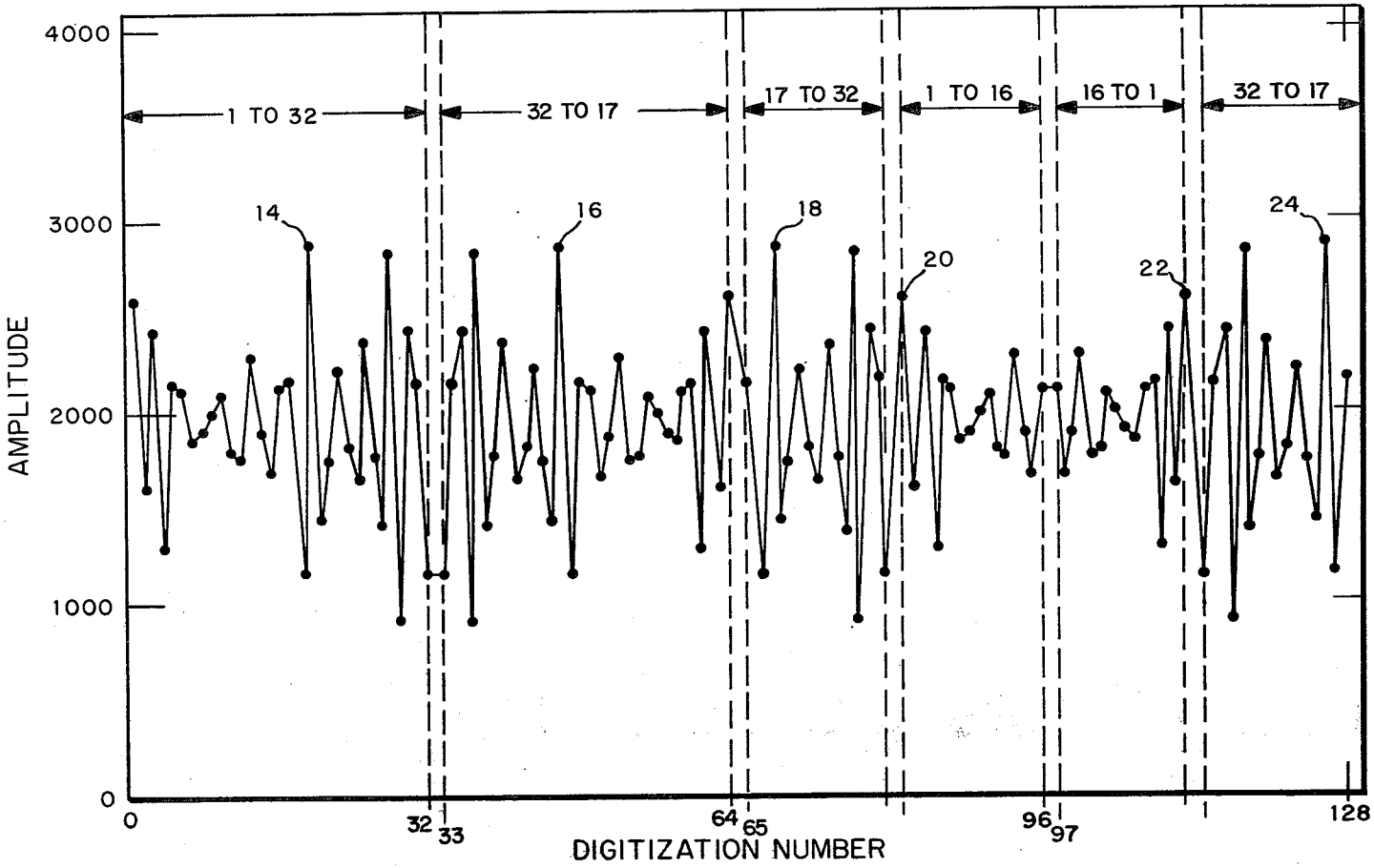
FIG. 3 is a waveform diagram of amplitude as a function of time which has been generated from the first thirty-two points of the waveform shown in FIG. 2.

A specific example of this procedure is illustrated by the 128-sample waveform 12 of FIG. 3, which is a reconstruction of the waveform 10' of FIG. 2.

According to the invention thirty-two consecutive samples have been stored to represent the entire 128-sample waveform. In FIG. 3, the thirty-two samples are registered in their entirety at the outset as segment 14, followed by a registration reversal of order as segment 16. Then samples 17 through 32 are registered as a shortened segment 18, followed by a registration of samples 1 through 16 as segment 20. Thereafter samples 16 through 1 are registered as segment 22, followed by samples 32 to 17 as segment 24. Thus the entire 128-sample waveform is synthesized by employing only 32 samples registered for reproduction in a group in a quasi-random sequence. A compression factor of four has been achieved.

Figure 4:
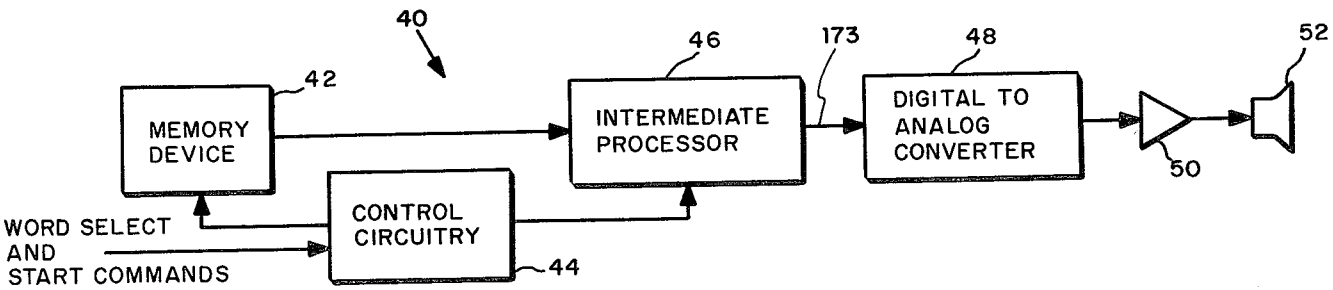
FIG. 4 is a block diagram of a time domain speech synthesizer.

In FIG. 4 is an example of a device 40 which is operative according to the invention. A memory device 42 stores the processed and compressed data, for example the first thirty-two samples of the 128-sample sequence. The memory device 42 is addressed by control circuitry 44 which identifies the data output to an intermediate processor 46 which reconstructs the desire output signal in digital form. The control circuitry also provides instructions to the intermediate processor 46. The digital output of the intermediate processor 46 is coupled to a digital-to-analog converter 48, which in turn excites an amplifier 50 to drive a speaker 52.

Figure 5:
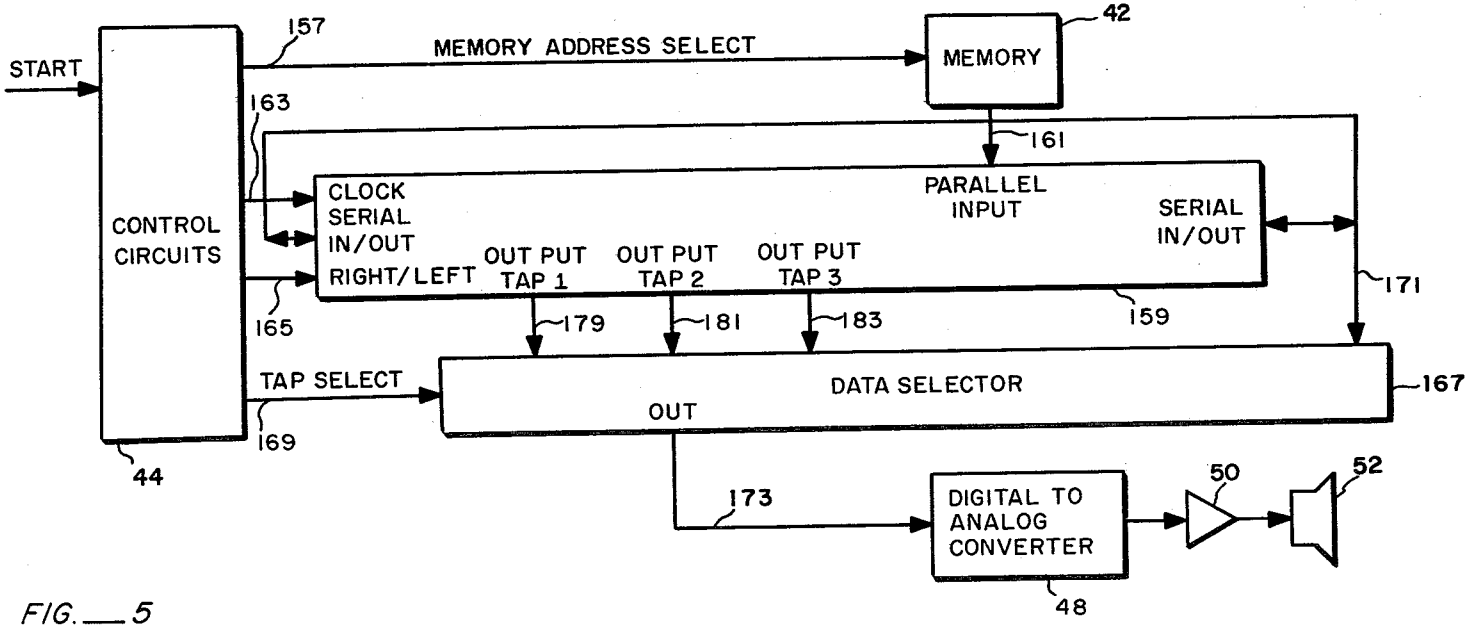
FIG. 5 is a block diagram of a portion of a intermediate processor in a time domain speech synthesizer employed for reconstructing a signal from a portion of a source signal.

FIG. 5 is an illustration of one implementation of the invention employing a bi-directional shift register 159 coupled to recirculate input data and with multiple taps for extracting data at various points.

In the device of FIG. 5 there are three taps provided output via lines 179, 181 and 183. Any number may be selected, depending on design considerations. In this embodiment the intermediate processor 46 (FIG. 4) consists of the shift register 159 and a data selector 167 being coupled to the converter 48. Control circuitry 44 generates a tap select signal via line 169 to control the selector output 173.

Operation of the system of FIG. 5 is as follows: Compressed speech information comprising data and instructions which characterize the time domain information of each substantially invariant segment of speech are stored in memory 42, typically in the form of Read Only Memory bits. A command is received via input control line 153 to select a particular word, phoneme group, phoneme, or segment. Control circuitry 44 decodes the command and locates the appropriate area in memory for each segment required by generating an address on memory address select bus 157 to the memory 42. The information addressed is parallel loaded via data bus 161 into shift register 159. Further control information is provided to the shift register 159 through clock line 163 and right-left shift signal line 165. The information read out of memory 42 is continuously clocked into the shift register 159 until it is filled.

At the same time, however, the data selector 167 is addressed by the tap select 169 of the control circuitry 44 to couple serial input/output line 171 to selector output 173. Data loaded from memory 42 is thus simultaneously passed to both the shift register 159 and the digital-to-analog converter 48, to appear as an audible output at the loudspeaker 52.

Once the shift register 159 is filled with accumulated data, the parallel input 161 is disabled to stop further data loading. Thereafter the synthesized digital representation of the waveform is generated from data already stored in the shift register 159. The waveform is reconstructed by playing out the data in various combinations backwards and forwards, using the right-left shift control through signal line 165, and by tapping data from different positions in the shift register sequence, using data selector 167 to select among taps 171, 179, 181 and 183.

FIG. 3 graphically illustrates the results of one specific algorithm. In a 128-bit sequence, the first 32 bits of a segment are grouped and are employed in forward and reverse sequence in alternating halves of the group in reverse order and in forward order.

Figures 6, 6A:
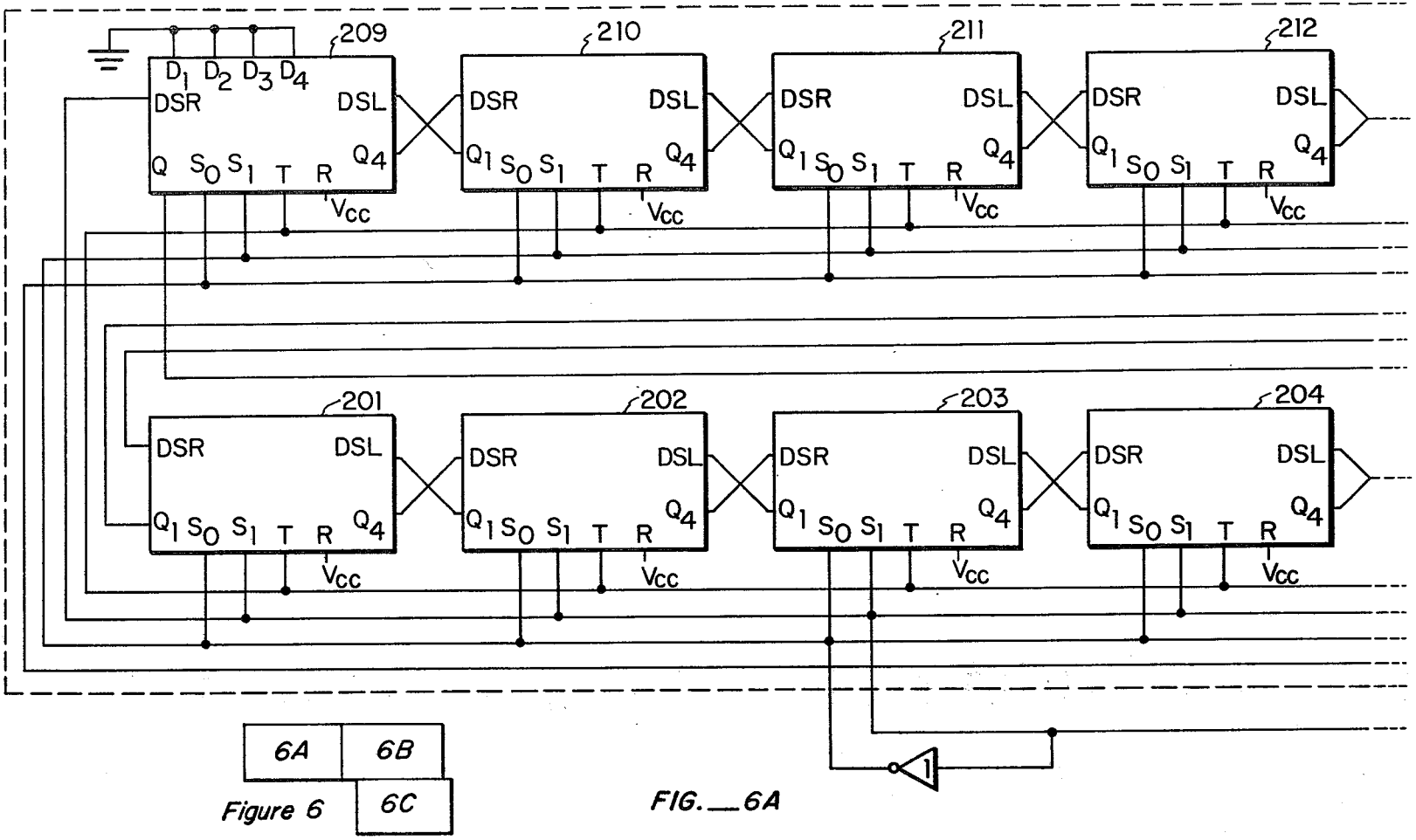
FIGS. 6, 6A, 6B and 6C are together a detailed circuit diagram of a specific embodiment of a time domain waveform synthesizer.
Figure 6B:
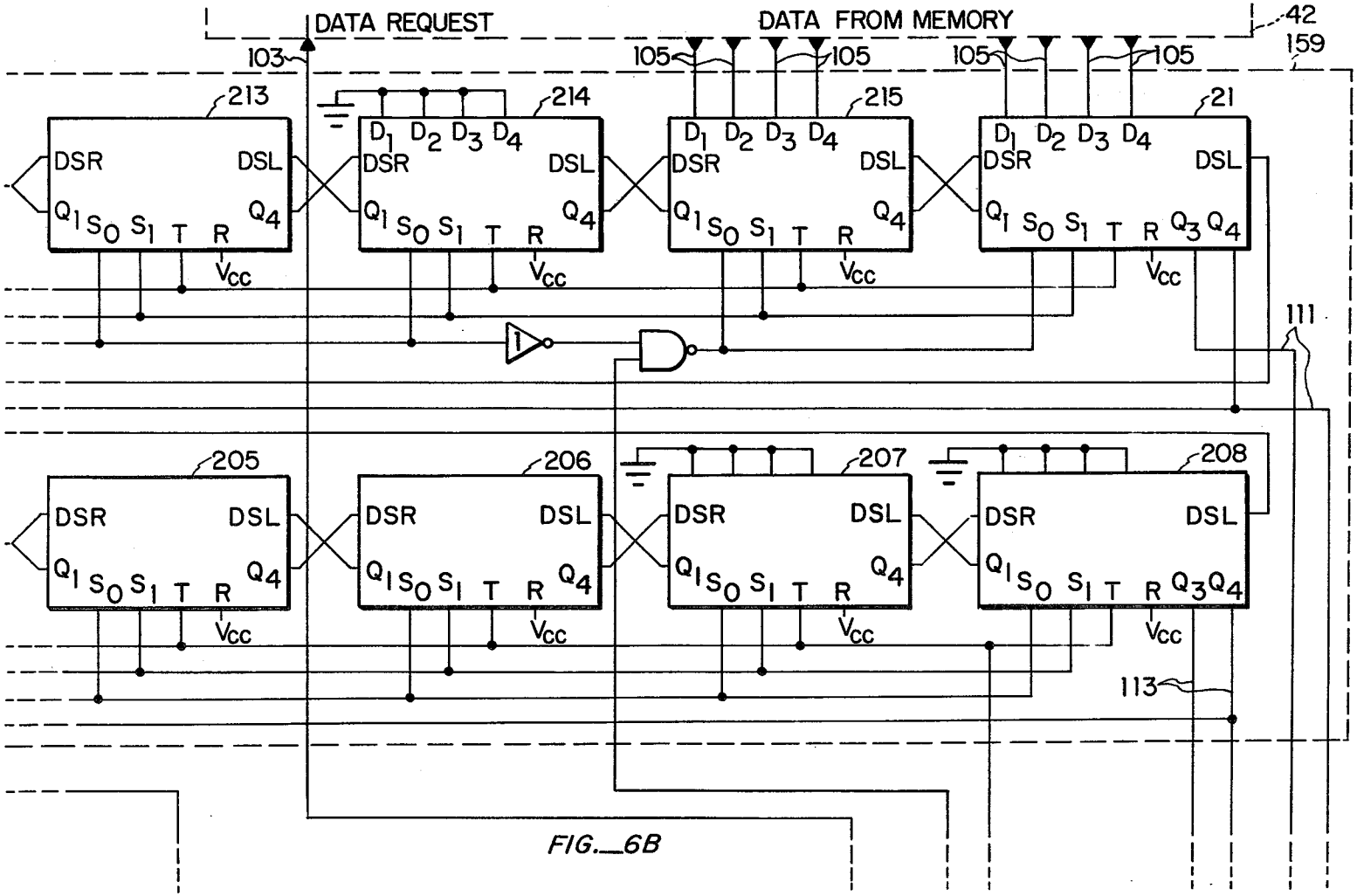
Figure 6C:
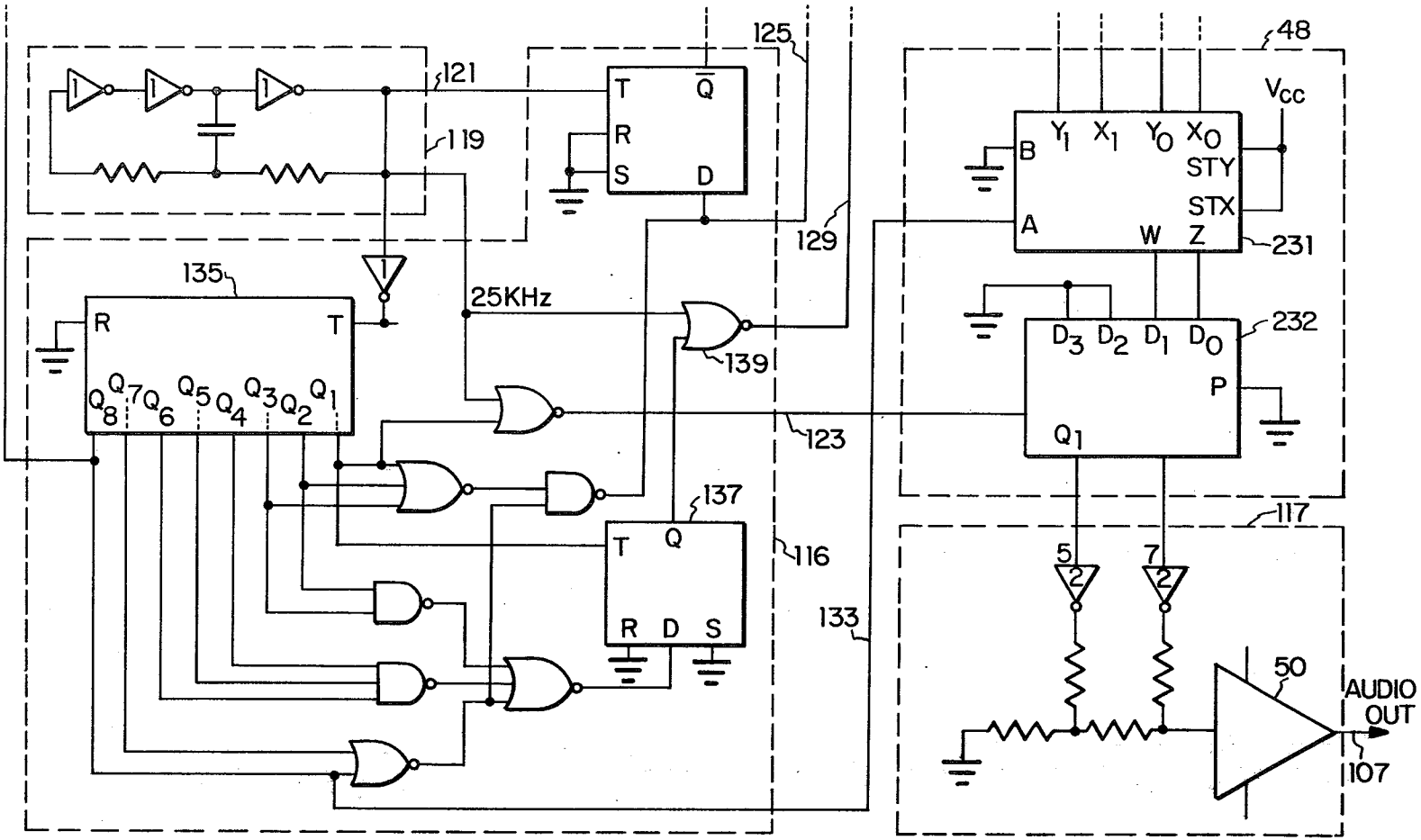

Standard CMOS integrated circuitry may be employed to construct specific embodiments of the invention. One such circuit is shown in FIG. 6. Data is stored in a memory 42. A rising voltage edge on a request line 103 causes the next data byte to appear on output line 105. An analog output signal representing the synthesized waveform will appear at output 107 of amplifier 50. The synthesized waveform will be of the form illustrated by FIG. 3.

The circuit of FIG. 9 comprises five major elements, a 64-bit bi-directional shift register 159 comprising sixteen 4-bit integrated circuit shift registers 201–216, such as type MC14194B, connected head to tail in a ring. Eight data output lines 105 are coupled to the last eight parallel input terminals of the shift register 159.

Two output terminals are employed in the shift register 159: Two signal lines 111 are taken off the end two bits $Q_3$ and $Q_4$ of the midpoint component 208. These two bit line sets are the selected taps on the shift register 159, which in turn are connected to the two input terminals of data selector 48, which includes a multiplexer 231 and latch 232. Since this particular device requires only four levels of resolution, a simple 2-bit digital-to-analog converter 117 is employed comprising a two rung R-2R ladder. The output is amplified by amplifier 50 to generate the desired analog output signal.

Figure 7:
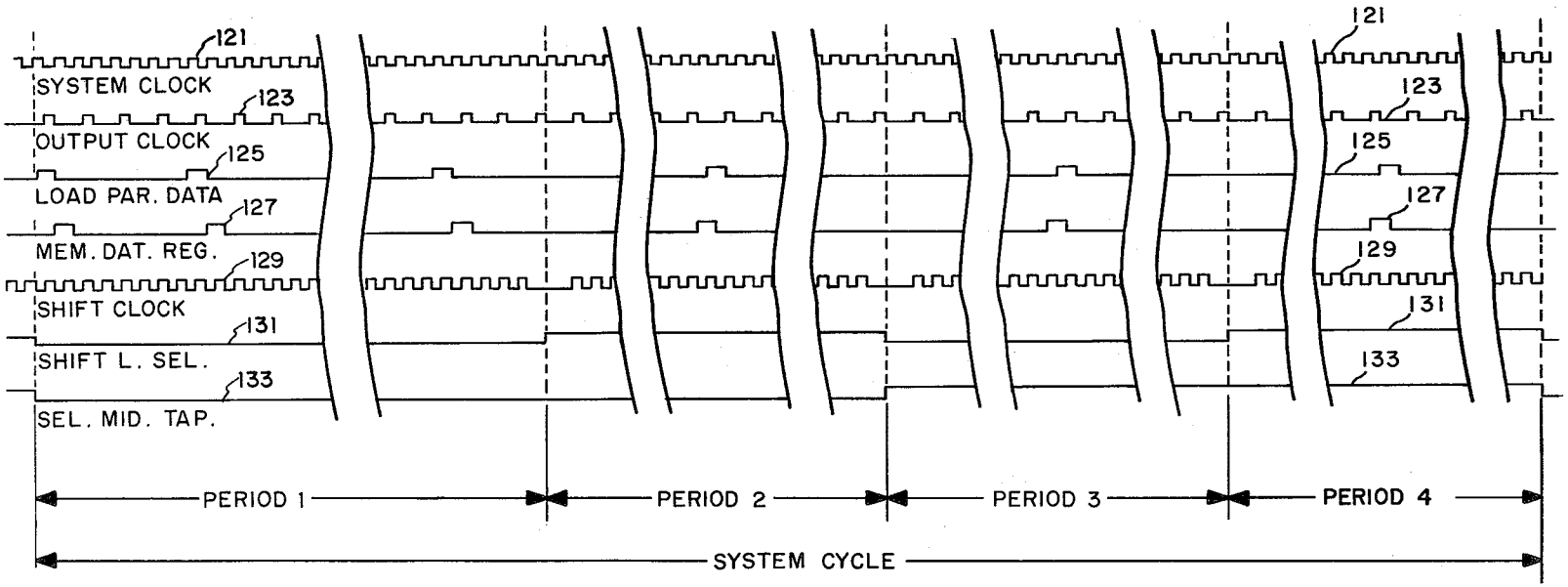
FIG. 7 is a set of timing diagrams for illustrating the operation of the circuit of FIG. 6.

The signal generation is controlled by control logic 116 driven by a system clock 119. The system clock 119 produces a 25 KHz square wave system clock signal 121, as shown in FIG. 7. Control logic produces the following control timing signals, as also shown in FIG. 7: Output Clock 123, Load Parallel Data 125, Memory Data Request 127, Shift Clock 129, Shift Left Select 131 and Select Midpoint Tap 133. Corresponding signal lines are identified in FIG. 6.

There are 256 clock states or 128 periods generated by an 8-bit binary counter 135. The outputs are then decoded by standard NAND and NOR gates to develop the desired timing signals.

In operation, referring to FIG. 7, eight data request pulses are developed during the first period (states 0 through 63), which are conveyed by memory data request signal lines 103, and eight bytes of data are loaded into shift register 159. Concurrently thirty-two pulses are generated on output clock line 123 to generate thirty-two periods of analog voltage on output signal line 107. Since Shift Left Select 131 is low, the data is shifted to the right (by convention). The Select Midpoint Tap Line 133, is also low so the data is taken from the end of the shift register 159 through lines 111.

During the second period (states 64 through 127), no data request pulses are generated. Since no new data is loaded, the data of the previous period remains and is circulated around the loop of the shift register 159. Shift Left Select is set high so data shifts left and plays out in reverse. The shift clock pulses which normally occur during states 63 and 64 are suppressed by gating the output of flip-flop 137 using NOR gate 139 with the shift clock. Thus the last output value of period one is repeated as the first output value of period two.

During period three, Shift Left Select 131 is set low and memory data request line 103 remains inactive. Midpoint select line 133 is set high so data is shifted forward and tapped from the middle of the shift register 159. Thus the same sequence of values as generated during period one is repeated starting at the midpoint, playing through to the end, continuing at the beginning and terminating at the midpoint.

During period four, Shift Left Select is set high so the sequence of period three is reversed. The shift clock pulses during states 191 and 192 are suppressed as during the previous reversal. The cycle is complete and ready to receive a new byte of information.

The foregoing discussion principally concerns the optimization of unvoiced audible signals which apply to speech analysis, compression and synthesis. Certain aspects of the invention may be applied equally well to other information where the information content is substantially devoid of any quasi-periodicity. It is therefore not intended that this invention be limited except as indicated by the appended claims.

I claim:

1. A method for synthesizing a unit of a time domain information signal substantially lacking periodic characteristics and having a power spectrum substantially invariant over the duration of said unit, said method comprising the steps of:

storing in memory means a representative small segment of said information signal unit; and repetitively reproducing at least a portion of said segment a sufficient number of times to reconstruct said information signal unit from said small segment, said reproducing step commencing and terminating with different points in said segment at each repetition thereby to provide a unit substantially free of noticeable periodicity.

2. The method according to claim 1 wherein said generating step further comprises commencing and terminating said portion in a manner to produce a plurality of serially-arranged portions of differing durations.

3. The method according to claim 1 or 2 wherein said generating step further includes reproducing said portion forwards and backwards in time.

4. A method for synthesizing a unit of a time domain information signal substantially lacking periodic characteristics and having a power spectrum substantially invariant during said time unit of interest wherein said information signal comprises discrete serially-arranged samples in a sequence, said method comprising the steps of storing said samples; and iterating repeatedly through said samples commencing and terminating with different samples at each repetition to reconstruct said unit of said information signal from said samples substantially free of noticeable periodicity.

5. The method according to claim 4 wherein said iterating step includes incrementing and decrementing through said samples.

6. The method according to claim 5 wherein at least sixty-four samples comprise a sequence and wherein said first iterating steps comprise incrementing from the first sample to the last sample then decrementing from the last sample to the first sample, then incrementing from no more than the first one-eighth sample to the last sample, then decrementing from the last sample to no more than the first one-eighth sample, then incrementing from a sample between the first one-eighth and first one-fourth sample to the last sample and then decrementing from the last sample to no more than the first one-eighth sample to achieve a duration sufficient to reconstruct a signal of period length corresponding to said unit of said information signal.

7. An apparatus for synthesizing a unit of a time domain information signal substantially lacking periodic characteristics and having a power spectrum substantially invariant during said time unit of interest, said apparatus comprising:

memory means for storing a representative small segment of said information signal;

means coupled to said memory means for generating a reconstructed signal from said information signal segment, said generating means comprising means for repetitively reproducing at least a portion of said signal segment commencing and terminating with different points in said segment at each repetition; and means for limiting said repetitions to a sufficient number of times to reconstruct said unit of said information signal from said small segment.

8. The apparatus according to claim 7 further including means for selecting the duration of each said segment portion.

9. The apparatus according to claim 7 or 8 wherein said generating means further includes means for reproducing said segment portion forward and backward in time.

10. The apparatus according to claim 7 wherein said information signal comprises descrete serially-arranged samples and wherein said generating means comprises means operative to iterate repeatedly through said samples of said segment beginning and ending with different samples.

11. The apparatus according to claim 10 wherein said iterating means comprises means operative to increment and decrement through said samples.

12. The apparatus according to claim 7 or 11 wherein said storage means comprises a serial shift register.

* * * * *